US012780506B2

(12) United States Patent
Liu

(10) Patent No.: US 12,780,506 B2
(45) Date of Patent: Nov. 3, 2026

(54) FOLDABLE CUP LID

(71) Applicant: Elston Investment Corp, Dover, DE (US)

(72) Inventor: Yang Liu, Dover, DE (US)

(73) Assignee: Elston Investment Corp

( * ) Notice: Subject to any disclaimer, the term of this patent is extended or adjusted under 35 U.S.C. 154(b) by 0 days.

(21) Appl. No.: 19/178,929

(22) Filed: Apr. 15, 2025

(65) Prior Publication Data

US 2026/0192990 A1 Jul. 9, 2026

(30) Foreign Application Priority Data

Jan. 9, 2025 (CN) ..... 202520051578.3

(51) Int. Cl.

| | |
|---|---|
| ***A47G 21/18*** | (2006.01) |
| ***A47G 19/22*** | (2006.01) |
| ***B65D 43/02*** | (2006.01) |
| ***B65D 47/06*** | (2006.01) |
| ***B65D 47/08*** | (2006.01) |

(52) U.S. Cl.

CPC ..... *B65D 47/066* (2013.01); *B65D 47/088* (2013.01); *A47G 19/2266* (2013.01); *B65D 2543/00046* (2013.01)

(58) Field of Classification Search

CPC ..... A47G 19/2266; A47G 19/2272; A47G 19/2222; A47G 21/18; B65D 47/065; B65D 47/066; B65D 47/088; B65D 47/305; B65D 47/32; B65D 2543/00046

USPC ..... 215/388, 229, 387; 220/707, 709, 708, 220/703, 254.3, 714; 222/528, 556; D7/396.2, 900, 510, 392.1

See application file for complete search history.

(56) References Cited

U.S. PATENT DOCUMENTS

| | | | | | |
|---|---|---|---|---|---|
| 5,242,079 | A | * | 9/1993 | Stephens | A47G 19/2266 222/536 |
| 5,325,982 | A | * | 7/1994 | Cobb, Jr. | A47G 19/2222 215/396 |
| D668,116 | S | * | 10/2012 | Eyal | D7/510 |
| D807,692 | S | * | 1/2018 | Yao | D9/449 |
| D894,672 | S | * | 9/2020 | Huang | D9/450 |

(Continued)

FOREIGN PATENT DOCUMENTS

| | | | |
|---|---|---|---|
| CN | 206213732 | U | 6/2017 |
| CN | 109744823 | A | 5/2019 |

(Continued)

*Primary Examiner* — Gideon R Weinerth

(74) *Attorney, Agent, or Firm* — Nitin Kaushik

(57) ABSTRACT

A foldable cup lid includes a lid body; a threaded groove formed on the lid body; a placement region formed on the lid body; a connecting tube fixedly attached to the lid body and in communication with the placement region; a suction tube hingedly connected to an inner wall of the placement region and corresponding to the connecting tube; a first hinge plate hingedly connected to the suction tube. The first hinge plate is located within the placement region when the suction tube is closed and flips over to contact a top surface of the lid body when the suction tube is opened; and a second hinge plate hingedly connected to the first hinge plate, wherein the second hinge plate is located within the placement region when the suction tube is closed and flips over to one side of the lid body when the suction tube is opened.

9 Claims, 7 Drawing Sheets

(56) References Cited

U.S. PATENT DOCUMENTS

| | | | | | |
|---|---|---|---|---|---|
| D924,624 | S | * | 7/2021 | Huang | D9/449 |
| D941,627 | S | * | 1/2022 | Lown | D9/449 |
| D945,210 | S | * | 3/2022 | Ni | D7/392.1 |
| D955,812 | S | * | 6/2022 | Ge | D9/450 |
| D960,637 | S | * | 8/2022 | Zhang | D7/391 |
| D994,153 | S | * | 8/2023 | Shi | D7/392.1 |
| 11,717,101 | B1 | * | 8/2023 | Gui | B65D 47/065 220/711 |
| D1,081,251 | S | * | 7/2025 | Chen | D7/392.1 |
| D1,090,171 | S | * | 8/2025 | Chen | D7/392.1 |
| D1,102,819 | S | * | 11/2025 | Chen | D7/392.1 |
| 2018/0332987 | A1 | * | 11/2018 | Lin | B65D 47/305 |
| 2025/0136335 | A1 | * | 5/2025 | Harris | B65D 43/0202 |
| 2025/0248547 | A1 | * | 8/2025 | McKenrick | B65D 47/065 |

FOREIGN PATENT DOCUMENTS

| | | | |
|---|---|---|---|
| CN | 213046424 | U | 4/2021 |
| CN | 216822680 | U | 6/2022 |

* cited by examiner

FOLDABLE CUP LID

CROSS-REFERENCE TO RELATED APPLICATIONS

This application claims a priority to Chinese Patent Application No. 2025200515783, filed Jan. 9, 2025, entitled "Foldable Cup Lid," which is hereby incorporated by reference in its entirety.

TECHNICAL FIELD

The present application relates to the field of cup lids, and more particularly, to a foldable cup lid.

BACKGROUND OF THE INVENTION

Cups are essential in daily life and come in a variety of types and shapes, commonly made of metal, glass, or plastic.

Reference may be made to Chinese Patent Publication No. 201620855467.9, which discloses a magnetic pop-up mechanism for a drinking cup lid. The mechanism includes an upper cup lid, a lid base, and an automatic button connecting the two. A plurality of strong magnets are arranged in spaced positions on the inner sidewall of the upper cup lid, and corresponding magnets of the same polarity are arranged on the lid base. When the automatic button is pressed, repulsion between the strong magnets causes the upper cup lid to open automatically, thereby improving the limited service life of conventional spring mechanisms and providing smoother, more convenient, and faster opening and locking.

However, in the above patent, when the lid is opened, it tilts to one side of the lid body. If a person tries to drink from that same side, the lid can interfere, limiting convenience.

Accordingly, a foldable cup lid is provided.

SUMMARY OF THE INVENTION

The present disclosure provides a summary of concepts that will be described in greater detail below. The summary is not intended to identify essential or key features of the claimed technical solutions, nor is it intended to limit the scope of the claimed technical solutions.

To address the technical problems mentioned in the background, some embodiments of the present disclosure provide a foldable cup lid, comprising: a lid body; a threaded groove formed in the lid body; a placement region formed in the lid body; a connecting tube fixedly attached to the lid body and in communication with the placement region; a suction tube hingedly connected to an inner wall of the placement region, corresponding to the connecting tube; a first hinge plate hingedly connected to the suction tube, wherein the first hinge plate is located within the placement region when the suction tube is closed, and flips over to contact a top surface of the lid body when the suction tube is opened; and a second hinge plate hingedly connected to the first hinge plate, wherein the second hinge plate is located within the placement region when the suction tube is closed, and flips over to one side of the lid body when the suction tube is opened.

As shown in FIG. 1, when the tube body is in the closed state, it is convenient to carry. When it needs to be opened, the protrusion is first pried, and then the second hinge plate and the first hinge plate are swung. Because the first hinge plate is hinged to a hinge portion, the hinge portion rotates, driving the tube body to rotate and thus open. When the tube body can no longer rotate, as shown in FIGS. 3 and 4, the tube body is in communication with the connecting tube for drinking. The top of the connecting tube is made of a sealing material to improve subsequent sealing. At this time, the second hinge plate is located at one side of the lid body and forms an angle of 80-100 degrees with the horizontal plane, which does not affect drinking from any angle. When closing is required, the first hinge plate and the second hinge plate are swung to place the suction tube entirely within the placement region. The first hinge plate and the second hinge plate are then returned to their original positions, as shown in FIG. 2, so that the tube body is positioned within the placement region for dust protection. At this time, the sealing rubber is located on the vent hole, and under the effect of the first pressing protrusion and the second pressing protrusion, the second hinge plate is compressed, thereby enhancing stability in the placement of the second hinge plate.

In some embodiments, when the suction tube is opened, the second hinge plate forms an angle of 80-100 degrees with the horizontal plane.

In some embodiments, the suction tube includes a tube body and a hinge portion. The tube body is fixedly connected to the hinge portion, the hinge portion is disposed in the placement region, and the first hinge plate is hinged to the hinge portion.

In some embodiments, a lap joint block is provided in the placement region, and the lap joint block corresponds to the second hinge plate.

n some embodiments, the second hinge plate is fixedly provided with a first pressing protrusion, and the first pressing protrusion corresponds to the lap joint block.

In some embodiments, a second pressing protrusion is fixedly provided on the lap joint block, and the second pressing protrusion corresponds to the second hinge plate.

In some embodiments, a protrusion is fixedly provided at an end of the second hinge plate remote from the first hinge plate.

In some embodiments, a vent hole is formed in a bottom wall of the placement region, and the suction tube is fixedly provided with sealing rubber corresponding to the vent hole.

In some embodiments, the first hinge plate is fixedly provided with a first reinforcing rib.

In some embodiments, the second hinge plate is fixedly provided with a second reinforcing rib.

The beneficial effects of the present disclosure include:

1 By providing the placement region, the first hinge plate, and the second hinge plate, when the suction tube is not in use, the suction tube can be placed in the placement region, and the first hinge plate and the second hinge plate can be closed, thereby achieving dust protection.

2 Because the first hinge plate is hinged to the hinge portion and the second hinge plate is hinged to the first hinge plate, when drinking is required, the first hinge plate can be rotated to the upper end of the lid body to contact the lid body, and the second hinge plate can be rotated to one side of the lid body at an 80-100 degree angle to the horizontal plane, preventing the second hinge plate from tilting on the side of the lid body in a way that would interfere with drinking.

BRIEF DESCRIPTION OF DRAWINGS

The drawings form a part of the present application and provide further understanding of the application, making other features, objectives, and advantages more apparent. The exemplary embodiments illustrated in the drawings and the accompanying descriptions are provided to explain the application and are not unduly limiting.

Additionally, throughout the drawings, the same or similar reference numerals denote the same or similar elements. It should be understood that the drawings are schematic, and elements are not necessarily drawn to scale.

In the drawings:

FIG. 1 is an overall schematic view according to an embodiment of the present application;

FIG. 2 is a sectional view of the lid body;

FIG. 3 is a perspective structural view showing the suction tube in an unfolded state;

FIG. 4 is a sectional view showing the suction tube in the unfolded state;

FIG. 5 is a perspective structural view;

FIG. 6 is an enlarged view of portion A in FIG. 2;

FIG. 7 is an enlarged view of portion B in FIG. 2.

REFERENCE CHARACTERS

Figure 1:
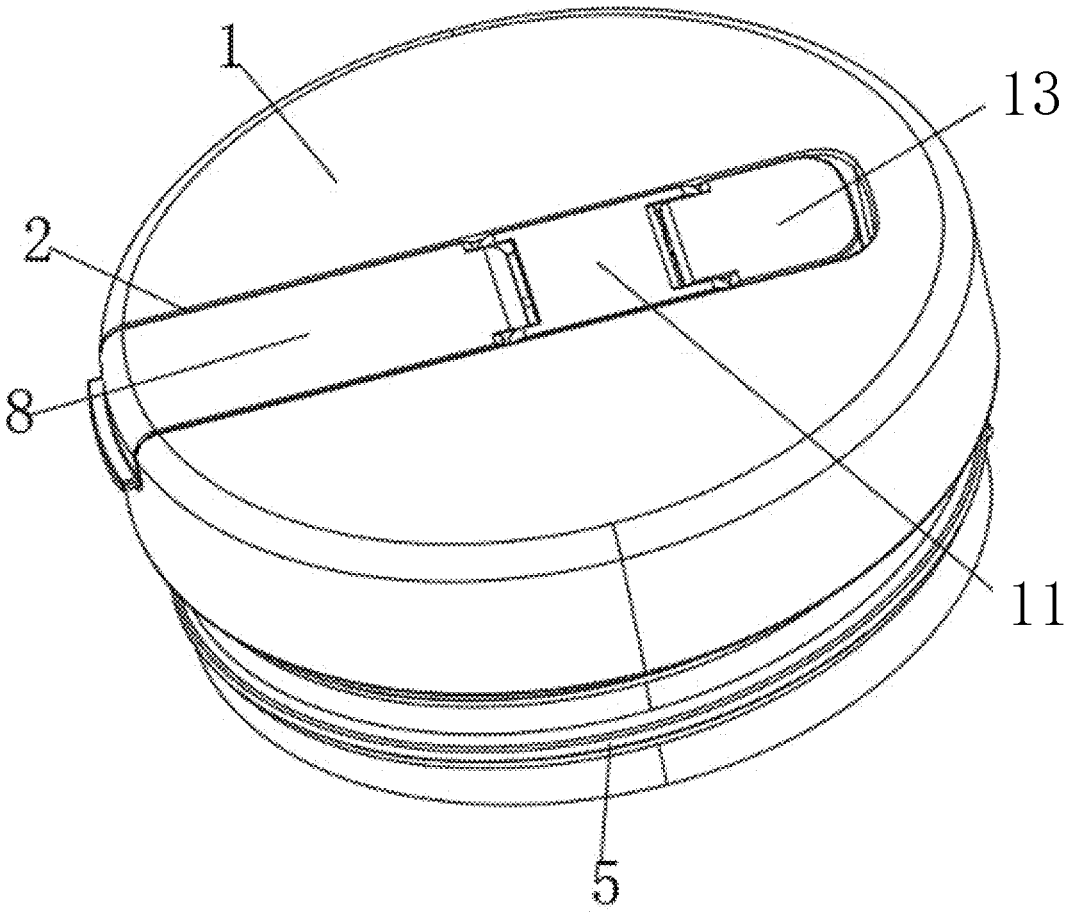

1, Lid body; 2, Placement region; 3, Lap joint block; 4, Second pressing protrusion; 5, Threaded groove; 6, Protrusion; 7, First pressing protrusion; 8, Second hinge plate; 9, Second reinforcing rib; 10, First reinforcing rib; 11, First hinge plate; 12, Suction tube; 13, Hinge portion; 14, Connecting tube; 16, Vent hole; 16, Sealing rubber; 17, Tube body

DETAILED DESCRIPTION OF THE INVENTION

Embodiments of the present disclosure will be described in greater detail below with reference to the drawings. Although certain embodiments are illustrated, it should be understood that the present disclosure may be implemented in various forms and should not be construed as limited to the examples set forth herein. Rather, these examples are provided to more thoroughly and comprehensively explain the disclosure. It should be understood that the drawings and embodiments of the present disclosure are provided for illustrative purposes only and are not intended to limit the scope of protection.

It should also be noted that, for ease of description, only certain parts relevant to the disclosed invention are shown in the drawings. Where there is no conflict, the embodiments and features disclosed herein may be combined with one another.

It should be noted that the concepts of "first," "second," etc., are used merely to distinguish different devices, modules, or units and do not limit the sequence of functions or interdependencies among these devices, modules, or units.

It should be noted that the use of "a" or "multiple" in the present disclosure is illustrative rather than restrictive. Unless explicitly stated otherwise, it should be understood to mean "one or more."

The present disclosure will now be described in detail with reference to the accompanying drawings and specific embodiments.

Referring to FIGS. 1-7, a foldable cup lid is provided, including: a lid body 1, a threaded groove 5, a placement region 2, a connecting tube 14, a suction tube 12, a first hinge plate 11, and a second hinge plate 8. The threaded groove 5 is formed on the lid body 1. The placement region 2 is formed on the lid body 1. The connecting tube 14 is fixedly attached to the lid body 1 and communicates with the placement region 2. The suction tube 12 is hingedly connected to an inner wall of the placement region 2 and corresponds to the connecting tube 14. The first hinge plate 11 is hingedly connected to the suction tube 12. When the suction tube 12 is closed, the first hinge plate 11 is located within the placement region 2, and when the suction tube 12 is opened, the first hinge plate 11 flips to contact the top surface of the lid body 1. The second hinge plate 8 is hingedly connected to the first hinge plate 11. When the suction tube 12 is closed, the second hinge plate 8 is located within the placement region 2, providing dust protection and convenient portability; when the suction tube 12 is opened, the second hinge plate 8 flips to one side of the lid body 1 and forms an 80-100 degree angle with the horizontal plane so as not to interfere with drinking from any angle. At this time, the tube body 17 is in communication with the connecting tube 14 for drinking. The suction tube 12 includes the tube body 17 and a hinge portion 13, the tube body 17 being fixedly attached to the hinge portion 13, which is disposed in the placement region 2, and the first hinge plate 11 is hinged to the hinge portion 13. A lap joint block 3 is provided in the placement region 2, corresponding to the second hinge plate 8.

A first pressing protrusion 7 is fixedly provided on the second hinge plate 8, corresponding to the lap joint block 3. A second pressing protrusion 4 is fixedly provided on the lap joint block 3, corresponding to the second hinge plate 8. The first pressing protrusion 7 and the second pressing protrusion 4 compress the second hinge plate 8, enhancing its stability. A protrusion 6 is fixedly arranged at the end of the second hinge plate 8 remote from the first hinge plate 11. A vent hole 15 is formed in the bottom wall of the placement region 2, and the suction tube 12 is fixedly provided with sealing rubber 16 corresponding to the vent hole 15. A first reinforcing rib 10 is fixedly provided on the first hinge plate 11 to improve its stability. A second reinforcing rib 9 is fixedly provided on the second hinge plate 8 to improve its stability.

Figure 2:
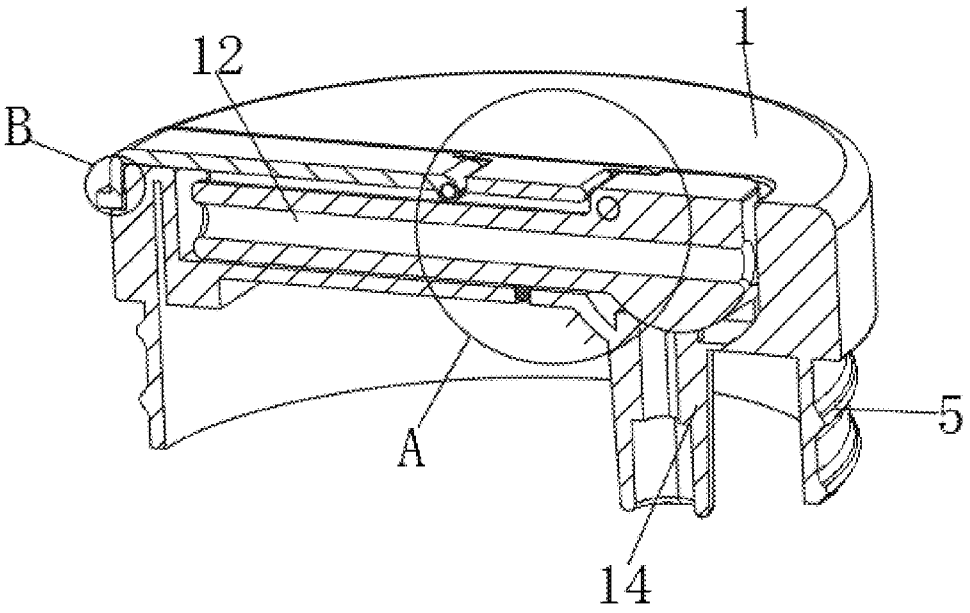
Figure 3:
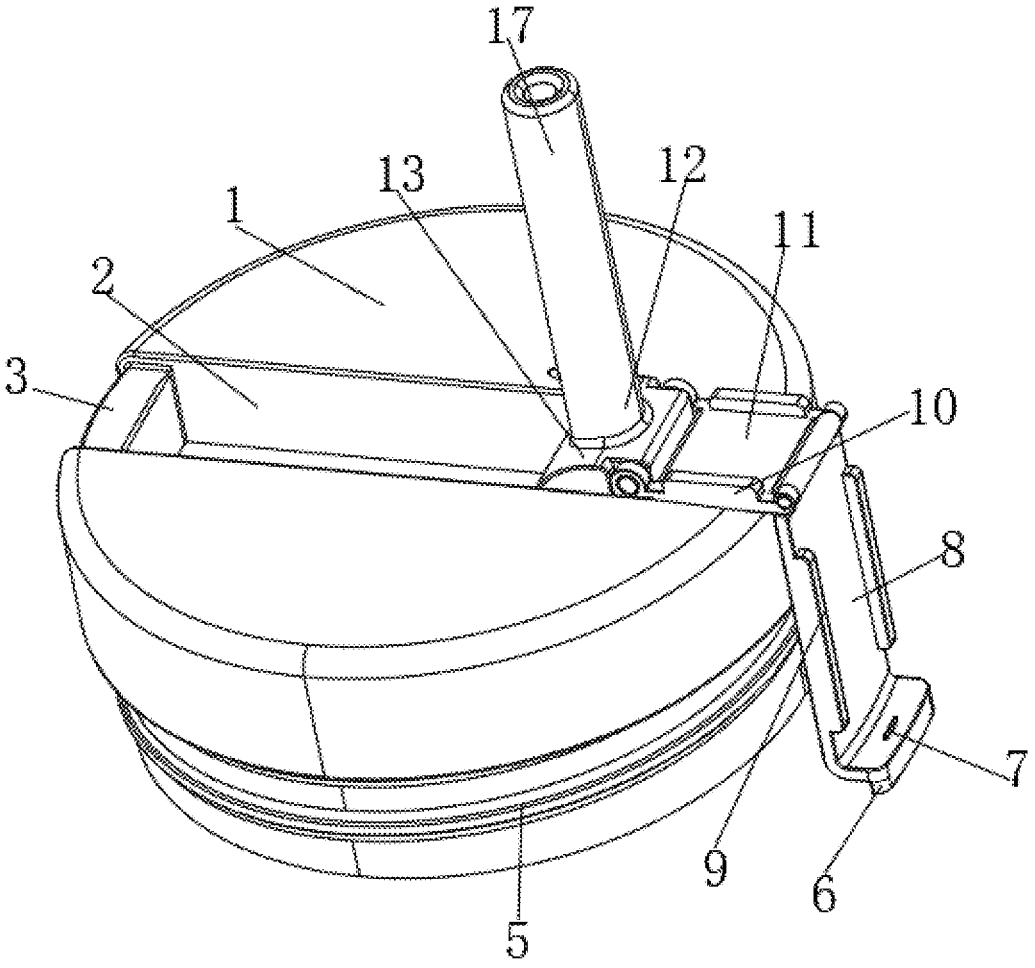
Figure 4:
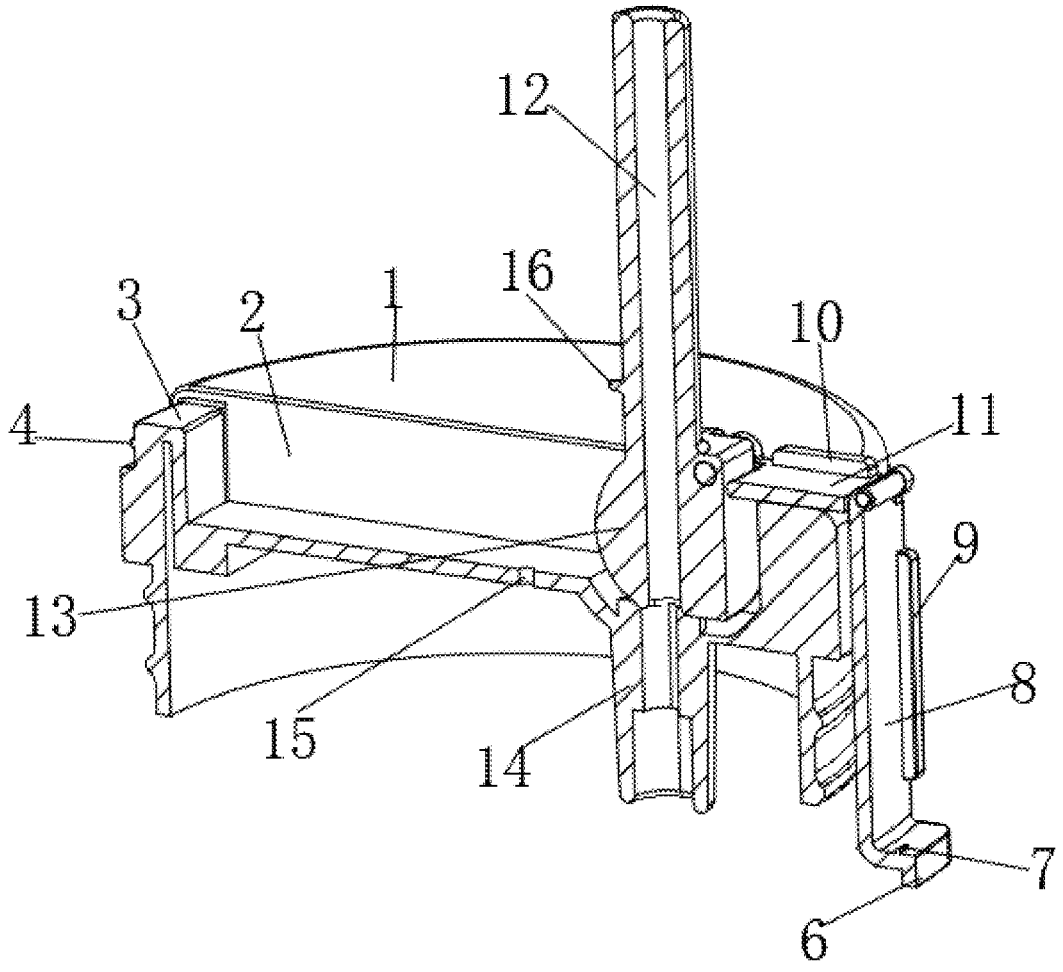
Figure 5:
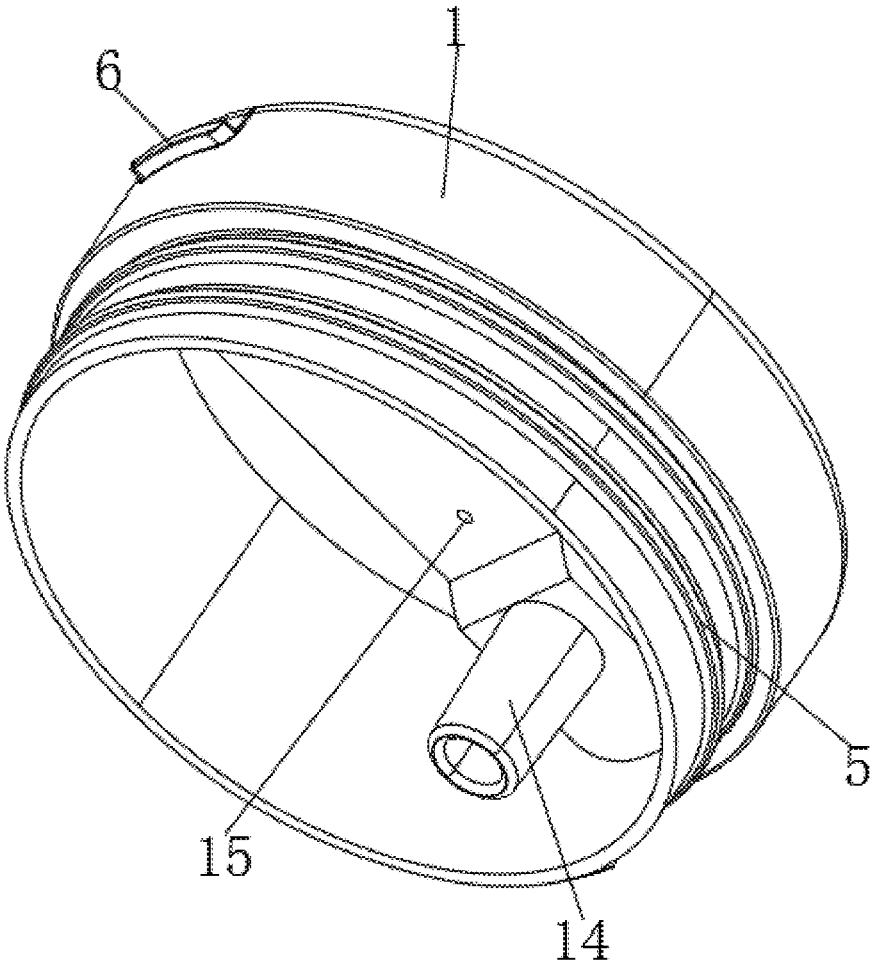
Figure 6:
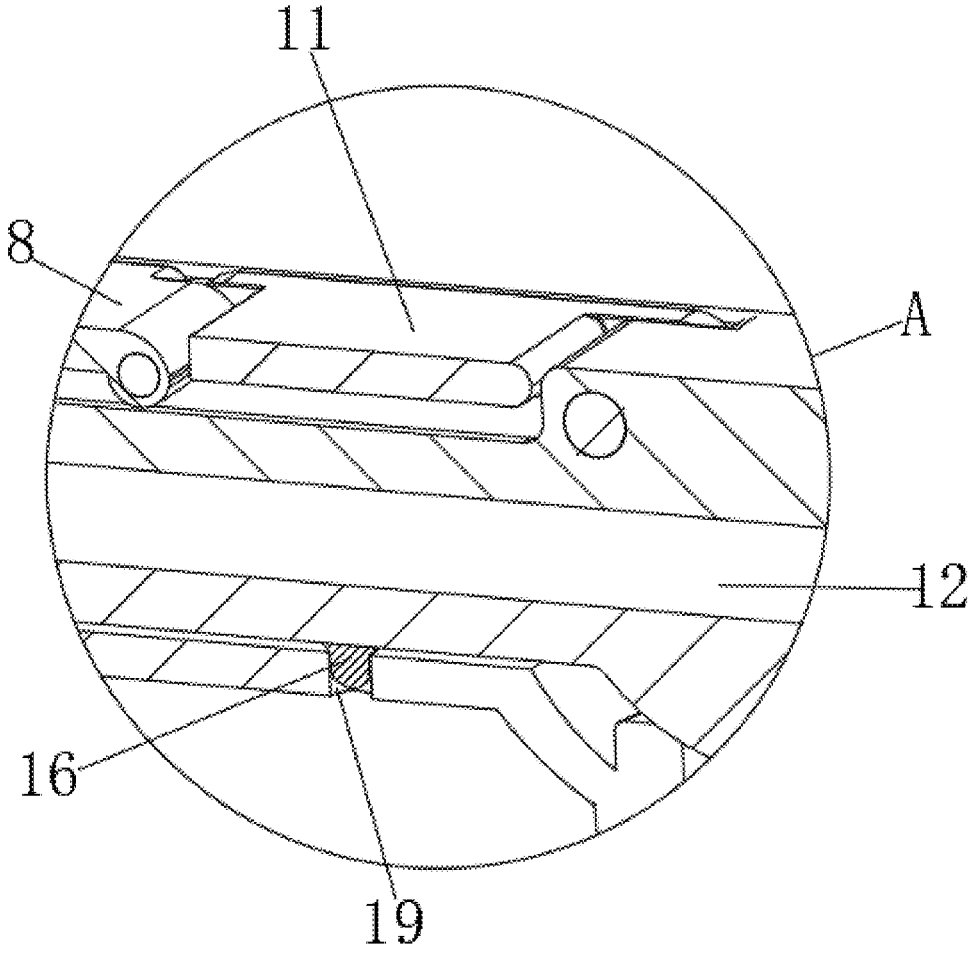
Figure 7:
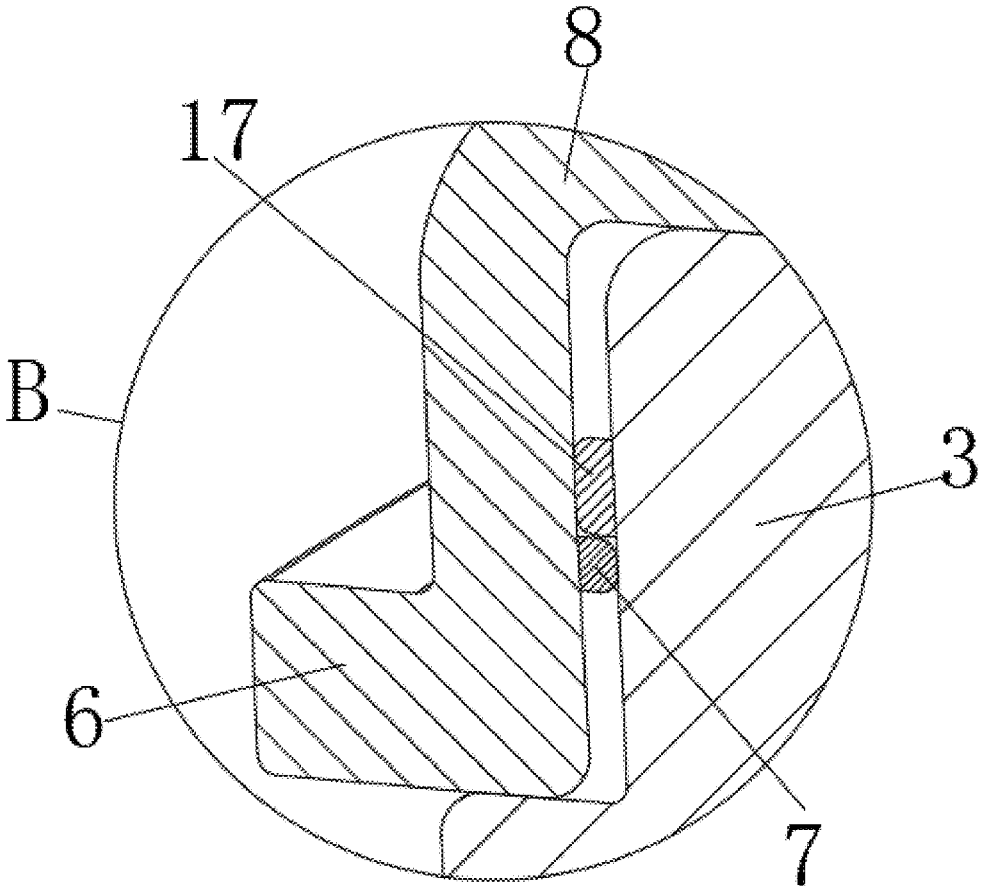

During operation, as shown in FIG. 1, the tube body 17 is in the closed state for convenient carrying. When opening is required, the protrusion 6 is pried, and then the second hinge plate 8 and the first hinge plate 11 are swung. Because the first hinge plate 11 is hinged to the hinge portion 13, the hinge portion 13 rotates, driving the tube body 17 to rotate and open. When the tube body 17 can no longer rotate (FIGS. 3 and 4), the tube body 17 is in communication with the connecting tube 14 for drinking, and the top of the connecting tube 14 is made of sealing material, thereby enhancing subsequent sealing. At this time, the second hinge plate 8 is positioned on one side of the lid body 1 at an 80-100 degree angle to the horizontal plane, ensuring it does not interfere with drinking. When closing is required, the first hinge plate 11 and the second hinge plate 8 are swung to place the suction tube 12 entirely inside the placement region 2. The first hinge plate 11 and the second hinge plate 8 then return to their original positions. As shown in FIG. 2, the tube body 17 is stored within the placement region 2, providing dust protection. At this time, the sealing rubber 16 is positioned on the vent hole 15, and under the action of the first pressing protrusion 7 and the second pressing protrusion 4, the second hinge plate 8 is compressed, thereby enhancing the stability of the second hinge plate 8 in its storage position.

The foregoing description merely sets forth several preferred embodiments and illustrates the technical principles applied therein. Those skilled in the art should understand that the scope of the invention disclosed herein is not limited to the specific combination of features described above. It should also cover any other technical solutions formed by any combination of the above features or their equivalents without departing from the inventive concept. For example, the above-described features may be interchanged with other similarly functioning features disclosed in, but not limited to, the embodiments of the present disclosure.

The invention claimed is:

1. A foldable cup lid, comprising:

a lid body;

a threaded groove formed on the lid body;

a placement region formed on the lid body;

a connecting tube fixedly attached to the lid body and in communication with the placement region;

a suction tube hingedly connected to an inner wall of the placement region and corresponding to the connecting tube, wherein the suction tube comprises a tube body and a hinge portion, the tube body being fixedly attached to the hinge portion, and the hinge portion being disposed in the placement region;

a first hinge plate hingedly connected to the suction tube, wherein the first hinge plate is located within the placement region when the suction tube is closed, and flips over to make face-to-face contact with a top surface of the lid body when the suction tube is opened; and a second hinge plate hingedly connected to the first hinge plate, wherein the second hinge plate is located within the placement region when the suction tube is closed, and flips over to one side of the lid body when the suction tube is opened;

wherein the second hinge plate is hinged to one end of the first hinge plate, the hinge portion is hinged to an opposite end of the first hinge plate, and the second hinge plate and the hinge portion are positioned on opposite sides of the first hinge plate in a diametrical direction of the lid body.

2. The foldable cup lid of claim 1, wherein the second hinge plate forms an angle of 80 to 100 degrees with the horizontal plane when the suction tube is opened.

3. The foldable cup lid of claim 1, wherein a lap joint block is provided in the placement region, corresponding to the second hinge plate.

4. The foldable cup lid of claim 3, wherein a first pressing protrusion is fixedly provided on the second hinge plate, corresponding to the lap joint block.

5. The foldable cup lid of claim 3, wherein a second pressing protrusion is fixedly provided on the lap joint block, corresponding to the second hinge plate.

6. The foldable cup lid of claim 1, wherein a protrusion is fixedly provided at an end of the second hinge plate remote from the first hinge plate.

7. The foldable cup lid of claim 1, wherein a vent hole is formed in a bottom wall of the placement region, and the suction tube is fixedly provided with sealing rubber corresponding to the vent hole.

8. The foldable cup lid of claim 1, wherein a first reinforcing rib is fixedly provided on the first hinge plate.

9. The foldable cup lid of claim 1, wherein a second reinforcing rib is fixedly provided on the second hinge plate.

* * * * *